US011766379B1

(12) United States Patent
Aviles et al.

(10) Patent No.: US 11,766,379 B1
(45) Date of Patent: Sep. 26, 2023

(54) ACUPRESSURE MASSAGE DEVICE

(71) Applicants: Alberto Aviles, Hazel Park, MI (US); Suzana Doncic, Hazel Park, MI (US)

(72) Inventors: Alberto Aviles, Hazel Park, MI (US); Suzana Doncic, Hazel Park, MI (US)

( * ) Notice: Subject to any disclaimer, the term of this patent is extended or adjusted under 35 U.S.C. 154(b) by 318 days.

(21) Appl. No.: 17/140,080

(22) Filed: Jan. 3, 2021

Related U.S. Application Data

(60) Provisional application No. 62/958,750, filed on Jan. 9, 2020.

(51) Int. Cl.
*A61H 7/00* (2006.01)

(52) U.S. Cl.
CPC ..... *A61H 7/003* (2013.01); *A61H 2201/1207* (2013.01); *A61H 2201/1635* (2013.01); *A61H 2201/1671* (2013.01); *A61H 2205/065* (2013.01)

(58) Field of Classification Search
CPC ..... A61H 7/003; A61H 2201/1207; A61H 2201/1635; A61H 2201/1671; A61H 2205/065
See application file for complete search history.

(56) References Cited

U.S. PATENT DOCUMENTS 5,709,647 A * 1/1998 Ferber ..... A61H 39/04 601/134
6,669,657 B1 * 12/2003 Ongwela ..... A61H 7/001 601/134
9,237,981 B1 * 1/2016 Clementes ..... A61H 7/00
2012/0143081 A1 * 6/2012 Lyu ..... A61H 23/06 600/557
2015/0173999 A1 * 6/2015 Vanderstegen-Drake ..... A61H 9/0092 601/151
2022/0087894 A1 * 3/2022 Chen ..... A61H 15/0085

* cited by examiner

*Primary Examiner* — Steven O Douglas

(57) ABSTRACT

The present invention is a motorized device used to apply pressure on a specific pressure point on a person's hand known to alleviate anxiety, pain, migraines, headaches and toothaches. The pressure point is located between the thumb and index finger in the web of the hand. The device consists of a motor and mechanism attached to two contact ends producing a circular motion while applying pressure to the specified pressure point. The mechanism is enclosed in ergonomic case suitable for use on both the left and right hand. Batteries are the source power.

4 Claims, 7 Drawing Sheets

ACUPRESSURE MASSAGE DEVICE

BACKGROUND OF THE INVENTION

The present application related to this device provides circular moving parts (magnetic or plastic), that can be held with either hand, to apply pressure or massage the pressure point between the thumb and first finger, for anxiety, pain, migraines, headaches and toothaches. This particular pressure point is well known in acupuncture to specifically give relief for anxiety, pain, migraines, headaches and toothaches.

Roughly 4 million adults in the United States suffer from daily migraines, and almost half to three quarters of adults between 18-65 have had a headache in the last year (www.who.int). This device offers relief to the people mentioned above, in a natural non-medicinal way. This pressure point can be targeted specifically for anxiety, pain, headaches and toothaches.

"In acupressure, pressure points are thought to be powerfully sensitive parts of the body. They are believed to identify spots that can relieve pain, establish balance, and improve health throughout the body" (www.healthline-.com.health.hand-pressure-points). The common suggestion is to use your hands to massage and apply pressure to this area for 10-15 minutes. Alternating between each hand for maximum relief.

This device targets and massages the pressure point between the thumb and index finger, where the web of flesh is, to offer relief. The device can be used on both hands, simply by rotating the device 180 degrees around to the other side.

BRIEF SUMMARY OF THE INVENTION

This device provides pressure to the specific pressure point between the thumb and index finger in the web of your hand, offering relief from anxiety, pain, migraines, headaches and toothaches simply by placing your hand in the device, making it hands free by requiring no manual intervention, aside from turning the device on and adjusting for desired pressure, while the device massages your hand.

The device is hand held and can be rotated by 180 degrees to use with either the left or right hand.

This device focuses primarily on one pressure point specifically targeted for anxiety, pain, migraines, headaches and toothaches.

DETAILED DESCRIPTION

In the following detailed description, the device according to the teachings for this application, is the form of a device that massages a particular pressure point for relief. It should be noted that this device can be used on either the left or right hand simply by rotating over the device 180 degrees to the other side as depicted on FIG. 5 and FIG. 6.

Figure 1:
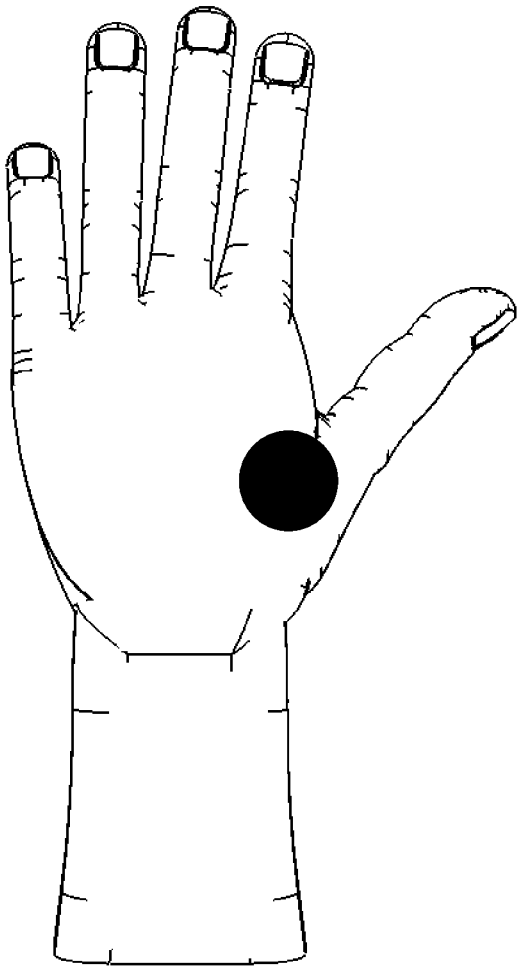
FIG. 1 depicts the mentioned pressure point location on the hand.

FIG. 1 depicts where the mentioned pressure point is located on the hand.

Figure 2:
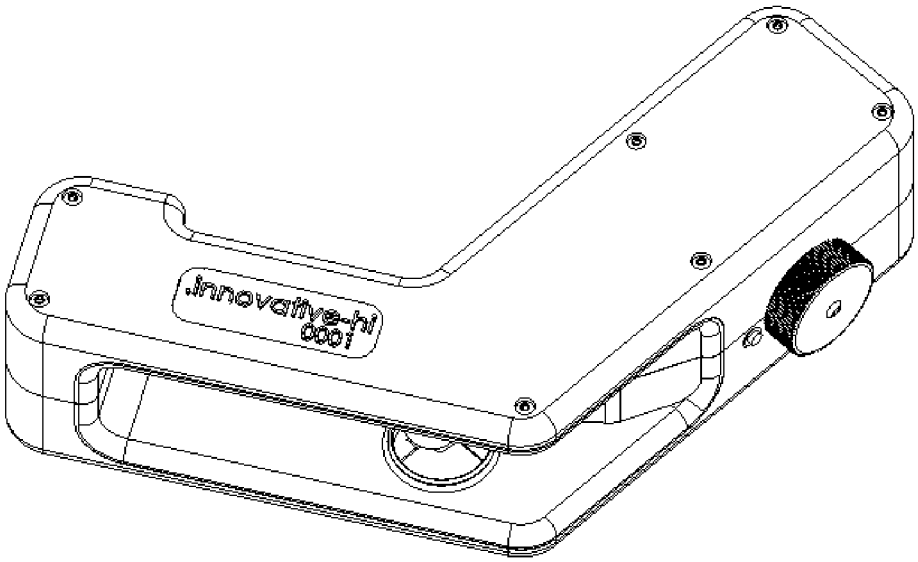
FIG. 2 is an isometric view of the device.

FIG. 2 is an isometric view of the device.

Figure 3:
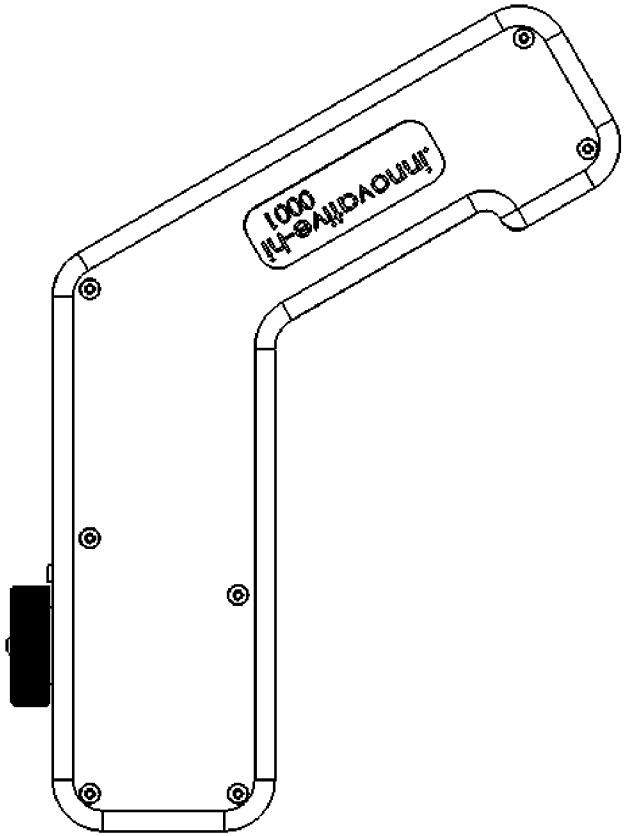
FIG. 3 is a top view of the device.

FIG. 3 is a top view of the device which depicts the ergonomic device shape on which one's hand can wrap around the handle in order to grip in place and apply further pressure on the mentioned pressure point. In this view, your left hand would be positioned with the thumb pointed to the right, and palm facing down.

Figure 4:
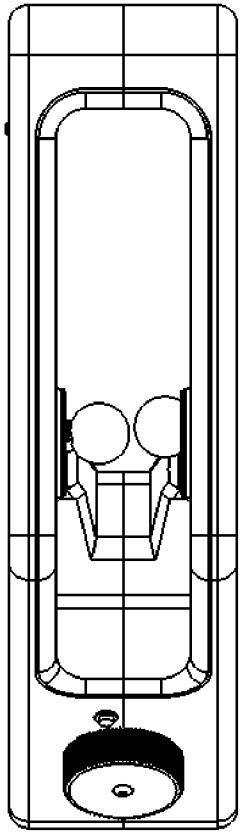
FIG. 4 is a front view of the device.

FIG. 4 is a front view of the device illustrating the opening in which one's hand should be inserted into the device, particularly the left hand in this orientation. The drawing also illustrates the contact massage points that make contact with the mentioned pressure point on one's hand.

Figure 5:
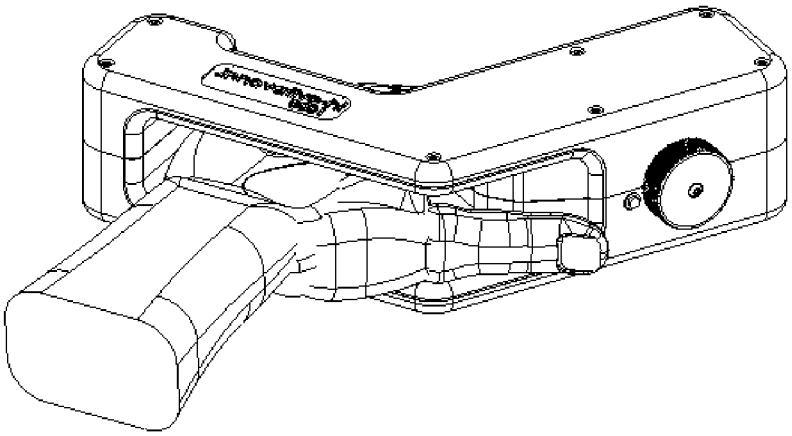
FIG. 5 is a view depicting the left hand placement in the device.

FIG. 5 Is an illustration of the left hand placement on the device for a proper use of the device.

Figure 6:
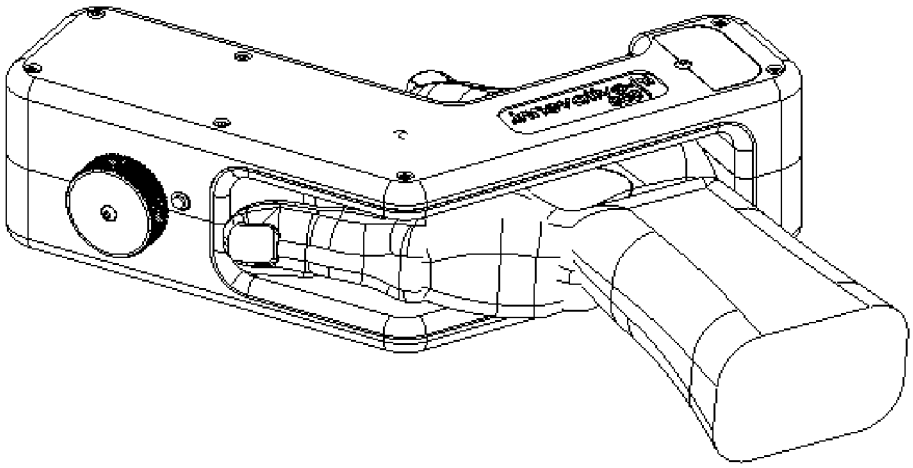
FIG. 6 is a view depicting the right hand placement on the device.

FIG. 6 Is an illustration of the right hand placement on the device for a proper use of the device.

Figure 7:
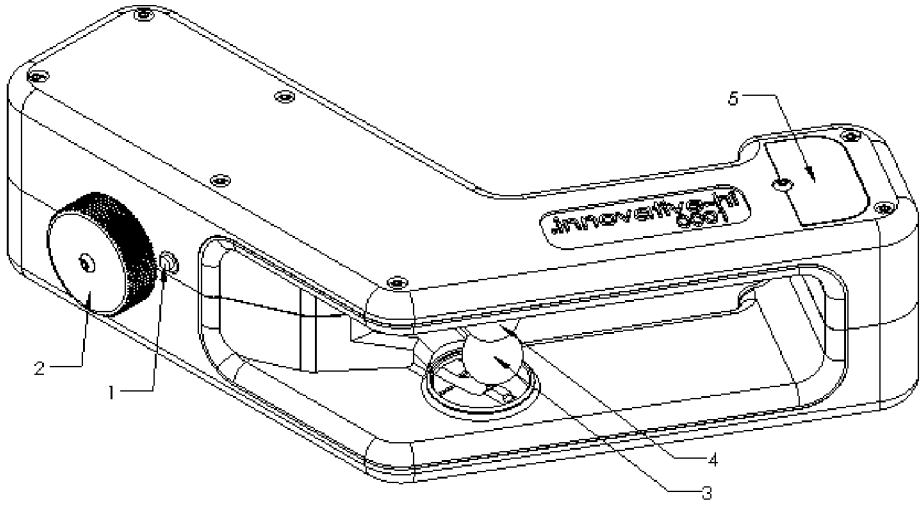
FIG. 7 is a view depicting the different parts of the device further explained in the detailed description.

FIG. 7 Is an diametric view of the device depicting the different parts of the device which go as follows: Line 1 is the ON/OFF Button pushed to turn device on or off. Line 2 is the Pressure Adjusting Knob that can be rotated clockwise and counter clock-wise to increase and decrease pressure, accordingly. Line 3 and 4 are the Rotational Magnetic or Non-Magnetic Contacts that apply pressure on the mentioned pressure point. Line 5 is the Battery Cover held by a screw that can be removed to replace batteries as needed.

The invention claimed is:

1. A hand held device to massage an acupressure point located on a user's hand by the base of the user's thumb and index finger, comprising of an ergonomically shaped case, arranged so as to house two spherical ends which rotate in a circular motion and provide pressure, massage and stimulate the acupressure point, an electric motor arranged to provide the necessary force to the two spherical ends, and a battery arranged to provide power to the electric motor.

2. A hand held device as in claim 1, wherein the case is arranged such that the acupressure point on either hand of the user can be stimulated.

3. A hand held device as in claim 1, where the two spherical rotating ends can be further adjusted to provide controlled pressure to fine tune the amount of massaged pressure applied by the spherical ends.

4. A hand held device as in claim 1, where the two spherical rotating ends which contact and provide pressure to the acupressure point is composed of materials including plastic polymer, or magnetic metals.

* * * * *